US006471467B1

(12) United States Patent
Pagalday

(10) Patent No.: US 6,471,467 B1
(45) Date of Patent: Oct. 29, 2002

(54) GRINDING DEVICE FOR A DRAIN PUMP

(75) Inventor: Xabier González Pagalday, Aretxabaleta (ES)

(73) Assignee: Fagor, S. Coop., Mondragon (ES)

( * ) Notice: Subject to any disclaimer, the term of this patent is extended or adjusted under 35 U.S.C. 154(b) by 28 days.

(21) Appl. No.: 09/717,491

(22) Filed: Nov. 21, 2000

(30) Foreign Application Priority Data

Nov. 22, 1999 (ES) ..... 9902561

(51) Int. Cl.[7] ..... B02C 23/36; F04D 7/04

(52) U.S. Cl. ..... 415/121.1; 134/115 G; 241/46.012; 241/46.013

(58) Field of Search ..... 415/121.1; 241/46.013, 241/46.012; 134/115 G

(56) References Cited

U.S. PATENT DOCUMENTS 2,421,064 A * 5/1947 Hilliker ..... 241/46.012
3,559,897 A * 2/1971 Carr ..... 241/46.013
4,183,470 A * 1/1980 Hovartos et al. ..... 241/46.013
5,256,032 A * 10/1993 Dorsch ..... 415/121.1

* cited by examiner

*Primary Examiner*—Christopher Verdier
(74) *Attorney, Agent, or Firm*—The Kline Law Firm

(57) ABSTRACT

A grinding device for a drain pump on a dishwasher appliance includes moving elements that turn integrally with the impeller (5) of the pump (4) and fixed elements joined to the pump hydraulic body (2). The grinding is carried out by the combination of a blade (6), provided with a plurality of vanes, which turns integrally with the impeller (5) and a fixed support (7), provided with a plurality of apertures **(7*a*), the gap between the blade (6) and the support (7) not being dependent on the fitting tolerances of the grinder assembly (1) in the hydraulic body (2) and the end play of the impeller (5)**.

8 Claims, 3 Drawing Sheets

GRINDING DEVICE FOR A DRAIN PUMP

TECHNICAL FIELD

The present invention relates to the component parts of pumps, in particular of centrifugal drain pumps for dishwashers, provided with a cutting and tearing device coupled to the pump, for the grinding of waste carried by the washing water.

PRIOR ART

Water re-circulation pumps that have a device coupled to the rotary shaft of the pump for cutting and tearing up or grinding the food waste borne by the washing water are known in dishwashers for the purpose of preventing said waste from blocking the sprayer. The waste is channeled to a collection chamber adjacent to the pump impeller and it is retained there after being ground by the cutting device until discharged by the drain pump at the end of the washing cycle. On dishwasher appliances provided with a grinder, the drain pumps have a filter built into the discharge pipe for holding back waste material.

U.S. Pat. No. 4,448,359 and U.S. Pat. No. 4,795,102 disclose centrifugal water re-circulation and drain pumps in a dishwasher appliance, wherein the pump impeller has a waste grinding device coupled, adjacent to the pump drain cavity input.

DE-4423150 discloses a cutting device provided with a ring or tubular blade support coupled to the pump impeller shaft, where the blades are mounted conically at a given angle in relation to the shaft, forming a water swirl chamber which houses a similarly tubular member in its interior with bowed counter blades.

DISCLOSURE OF THE INVENTION

The object of the invention is to provide a grinding device for a dishwasher appliance drain pump, as defined in the claims. The grinding device according to the invention is of simple construction and can be easily coupled to the impeller of a common drain pump. It is not necessary to effect any modification in the structure of the drain pump.

The grinder device of the invention carries out thorough grinding of the waste, which enables the retaining filter that protects the pump to have a larger mesh or even permits dispensing with this filter. This grinding also prevents blockages in the pump and makes it possible for the waste reaching the drain circuit to be small enough not to cause problems in the drain circuit to which the dishwasher is coupled.

The grinder device covered by the invention includes a moving blade that rotates integral with the drain pump impeller and a fixed support adjacent to said blade, which has a plurality of apertures and is attached to the hydraulic body of the pump. The fixed support with its apertures acts as a fixed blade in combination with the moving blade, forming a moving blade—fixed blade assembly.

The gap between the moving blade and the fixed support is small and irrespective both of the assembly tolerances of the grinding device in the pump hydraulic body and of the pump impeller end play.

DETAILED DISCLOSURE OF THE INVENTION

Figure 1:
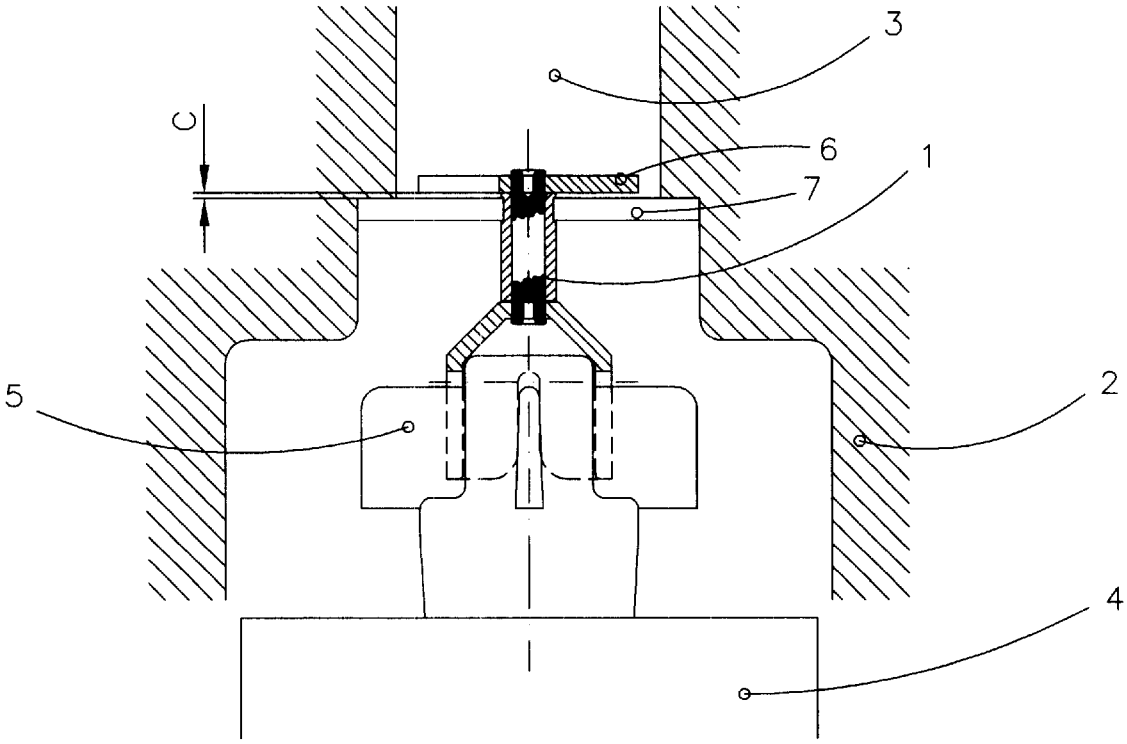
FIG. 1 is a longitudinal section view of the grinding device covered by this patent, mounted in the pump hydraulic body and coupled to the pump impeller.
Figure 2:
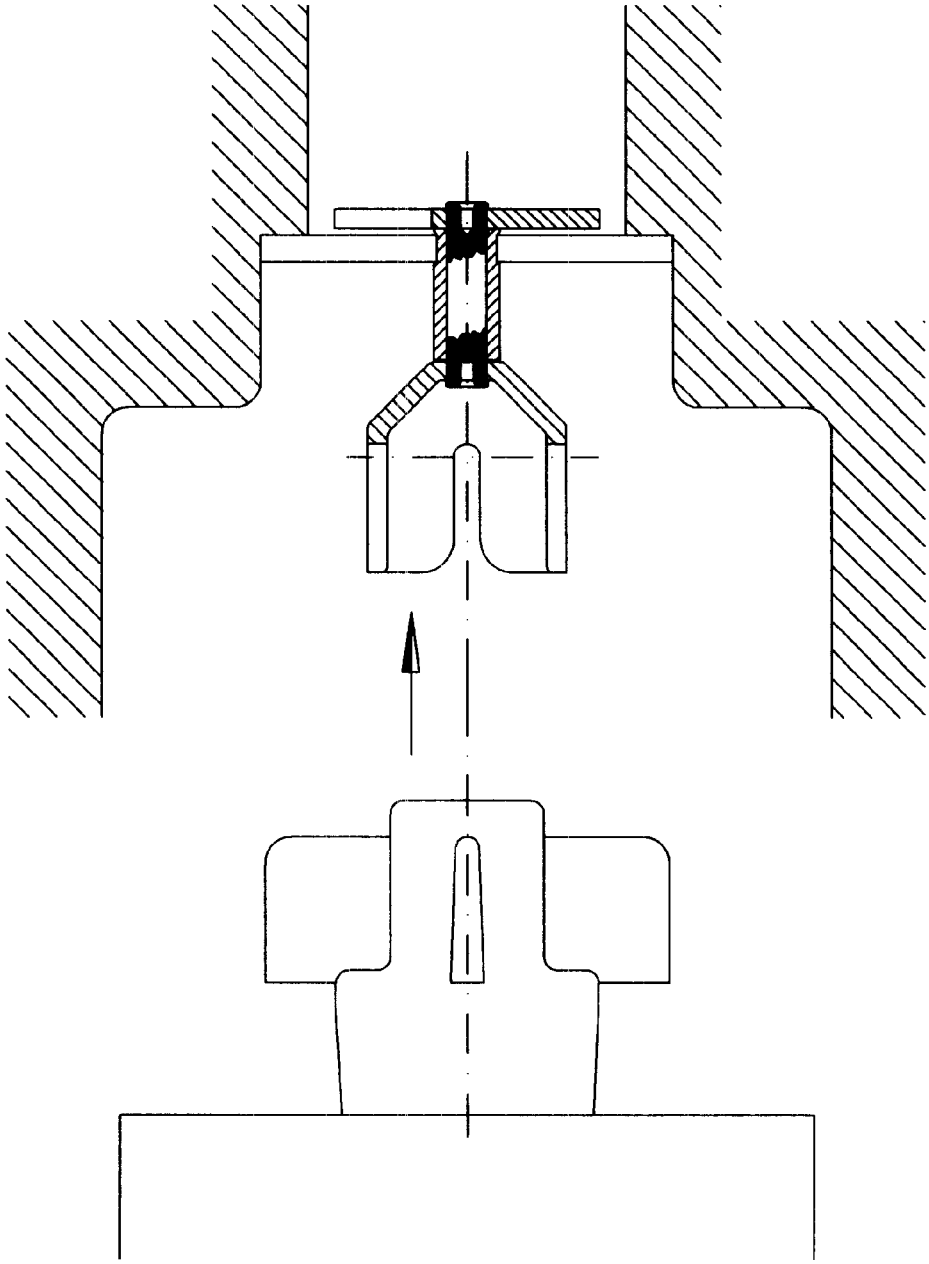
FIG. 2 is a longitudinal section view of the grinding device covered by the invention, as mounted in the pump hydraulic body and before being coupled to the pump impeller.

FIG. 1 shows an embodiment of the grinding device. The grinding assembly 1 is housed in the hydraulic body 2 and is coupled to the impeller 5 of the drain pump 4. When the hydraulic body 2 is part of the tank of the dishwasher (not shown), the process of installing the grinder assembly 1 is the following: first the support 7 of the grinder assembly 1 is mounted in said hydraulic body 2, and then the grinder assembly 1 is coupled to the impeller 5 of the drain pump 4, as shown in FIG. 2. When the hydraulic body 2 is an independent element, the grinder assembly 1 is mounted in said hydraulic body 2 and the grinder assembly 1 is coupled to the impeller 5 before the installation of the drain pump 4 in the dishwasher.

Figure 3:
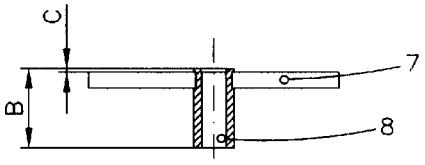
FIG. 3 is a longitudinal section view of the fixed means of the grinding device.
Figure 4:
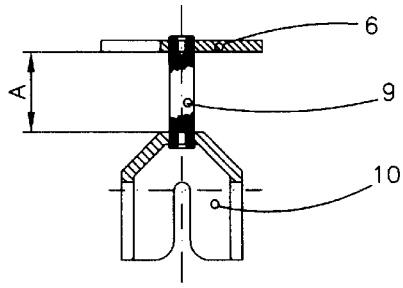
FIG. 4 is a longitudinal section view of the moving means of the grinding device.
Figure 5:
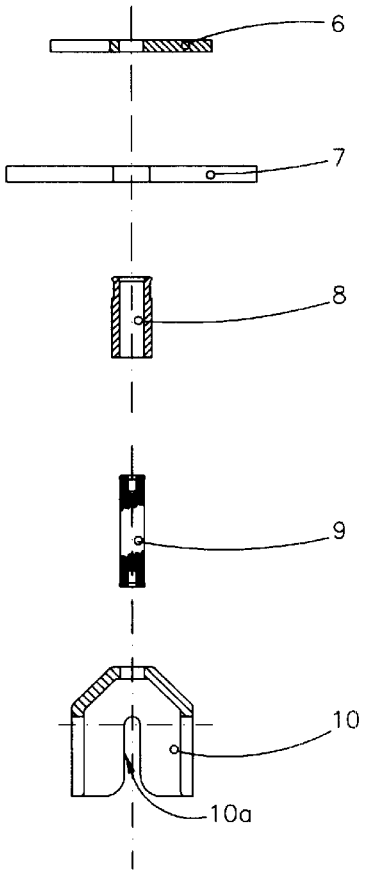
FIG. 5 is an exploded view of the grinding device.

The assembly 1 comprises fixed means attached to the hydraulic body 2 and moving means, which rotate integral with the impeller 5. FIG. 3 shows the fixed means of the assembly 1, which include an anchor support 7 and a guide bushing 8. FIG. 4 shows the moving means of the assembly 1, which include a blade 6, a shaft 9 and a coupling bush 10. FIG. 5 shows all the components of the assembly 1 in an exploded view.

The shaft 9 is associated rigidly with the coupling bush 10, or else forms part of it. The bush 10 is adapted to the shape of the impeller and has a plurality of grooves 10*a* which house the vanes of said impeller 5, thereby permitting the rotation of the moving means integral with the impeller 5. The grooves 10*a* are slightly wider than the vanes of the impeller 5, so that the vanes of the impeller 5 are inserted into them easily during the pump assembly process.

The support 7, which anchorers the assembly 1 in the hydraulic body 2, is provided with apertures 7*a* separated by ribs 7*b*. Together with the blade 6, these ribs 7*b* carry out the grinding of the waste material that arrives from the inlet pipe 3, forming the moving blade—fixed blade assembly. This support 7 is associated rigidly or forms a single part with the guide bushing 8, inside which the shaft 9 is housed and which serves to align the grinder assembly 1 mounted on the inlet pipe 3 with the impeller 5 of the pump 4.

The blade 6 is placed at the end of the shaft 9, rigidly associated with it and in a position close to the support 7. The efficiency of this grinding system depends on the number of vanes 6*a* of the blade 6, the size and number of the apertures 7*a* of the support 7, and the gap between the blade 6 and the support 7 (the smaller the gap, the more efficient the grinding).

The device covered by the invention enables the gap between the blade 6 and the support 7 to be controlled easily and it is not affected either by the fitting tolerances of the assembly 1 in the body 2 or by the end play of the impeller 5. It should be remembered that the end play of the drain pump is three or four times greater than the desired gap between the blade 6 and the support 7.

Between the blade 6 and the support 7 there is a gap C which is determined by the portion of the guide bushing 8 that projects from the support 7. The actual gap between the blade 6 and the support 7 will only depend on the fitting tolerance of the parts of the assembly 1 themselves. That tolerance value of the gap between the blade 6 and the support 7 will be determined by the clearance that the fixed means of the assembly 1 have between the blade 6 and the bushing 10, the difference between dimension A shown in FIG. 4 and dimension B shown in FIG. 3.

Figure 6:
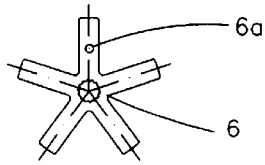
FIG. 6 is a front view of the grinding device blade.
Figure 7:
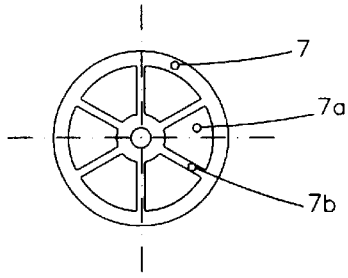
FIG. 7 is a front view of the grinding device fixed support.

As stated before, two of the factors that determine the efficiency of the grinding are the number of vanes 6*a* of the blade 6 and the number of the apertures 7*a* of the support 7. In the preferred embodiment, the blade 6 is fitted with five vanes 6*a* (as shown in FIG. 6), while the support 7 has six apertures 7*a* (as shown in FIG. 7).

What is claimed is:

1. A grinding device for a drain pump in a dishwasher appliance, said drain pump comprising a hydraulic body and an impeller, said grinding device comprising:

moving means which rotate integrally with said impeller, said moving means comprising a blade, a coupling bushing conforming to a shape of the impeller, and a shaft linking said blade to said coupling bushing, and fixed means comprising a guide bushing to receive said shaft and a support attached to the hydraulic body, said support having a plurality of apertures, and said blade being substantially parallel to said support; wherein said fixed means hold said moving means and a grinding process is carried out by cooperation of said blade with said support.

2. The grinding device according to claim 1 wherein:

said blade comprises a plurality of vanes.

3. The grinding device according to claim 2 wherein:

said blade comprises five of said vanes with an angle of approximately 72° between adjacent pairs of said vanes.

4. The grinding device according to claim 1 wherein:

said apertures of said support are separated by radially extending ribs.

5. The grinding device according to claim 4 wherein:

said support comprises six of said robs with an angle of approximately 60° between adjacent pairs of said ribs.

6. A grinding device for a drain pump in a dishwasher appliance, said drain pump comprising a hydraulic body and an impeller, said grinding device comprising:

moving means which rotate integrally with the impeller, and fixed means joined to the hydraulic body; wherein a grinding process is accomplished by a blade with a plurality of vanes and a fixed support with a plurality of apertures, said blade rotating integrally with the impeller, a gap between said blade and said support not being dependent on fitting tolerances of elements of said grinding device and of an end play of the impeller; and wherein said moving means comprise a coupling bushing conforming to a shape of the impeller, said coupling bushing comprising grooves to receive vanes of the impeller, said moving means further comprising a shaft linking said blade to said coupling bushing, and said fixed means comprises a guide bushing that receives said shaft.

7. The grinding device according to claim 6 wherein:

said blade has five vanes.

8. The grinding device according to claim 6 wherein:

said support has six apertures.

* * * * *